US008342892B2

(12) United States Patent
Fan et al.

(10) Patent No.: US 8,342,892 B2
(45) Date of Patent: Jan. 1, 2013

(54) HIGH CONDUCTIVITY ENERGY-SAVING CLAMPING DEVICE

(75) Inventors: YePing Fan, Shanghai (CN); Yong Wu, Shanghai (CN); ZhangXi Yan, Shanghai (CN); Di Yu, Shanghai (CN); Wei Duan, Shanghai (CN)

(73) Assignees: Shanghai Guangwei Electric & Tools Co., Ltd, Shanghai (CN); Shanghai Power Station Co., Ltd, Shanghai (CN); Shanghai Greatway Top Power Co., Ltd, Shanghai (CN)

( * ) Notice: Subject to any disclaimer, the term of this patent is extended or adjusted under 35 U.S.C. 154(b) by 80 days.

(21) Appl. No.: 13/126,149

(22) PCT Filed: Jul. 9, 2010

(86) PCT No.: PCT/CN2010/001016

§ 371 (c)(1),
(2), (4) Date: Apr. 26, 2011

(87) PCT Pub. No.: WO2011/120207

PCT Pub. Date: Oct. 6, 2011

(65) Prior Publication Data

US 2011/0287673 A1 Nov. 24, 2011

(30) Foreign Application Priority Data

Apr. 2, 2010 (CN) ..... 2010 1 0139105

(51) Int. Cl.
*H01R 11/24* (2006.01)

(52) U.S. Cl. ..... 439/822; 439/930

(58) Field of Classification Search ..... 439/822, 439/726, 729, 755–756, 759, 506, 930
See application file for complete search history.

(56) References Cited

U.S. PATENT DOCUMENTS 2,595,057 A * 4/1952 Cotter ..... 403/213
2,972,125 A * 2/1961 Temple et al. ..... 439/281
(Continued)

FOREIGN PATENT DOCUMENTS

CN 2424540 3/2001
(Continued)

OTHER PUBLICATIONS

Search Report for PCT/CN10/01016 dated Jan. 6, 2011.

*Primary Examiner* — Neil Abrams
*Assistant Examiner* — Phuongchi Nguyen
(74) *Attorney, Agent, or Firm* — Levenfeld Pearlstein, LLC

(57) ABSTRACT

The high conductivity energy-saving clamping device comprises a clamp and a cable fixed upon the clamp. Inside the cable, the conductive material protrudes and is set on the juncture of the clamp and the external conductor. When the clamp is connected to the external conductor, the conductive material and the external conductor contact and meet. This invention possesses the following advantages: it simplifies the production technology, lessens raw materials needed for production and hence saves resources and cost by the direct contact of the conductive material and the external conductor; moreover, due to the increase of conductive contact area, it enhances the electrical conductivity by 10% to 15% compared to those common clamps which use tooth-like conductive parts to connect the external conductor. Meanwhile, the invention greatly decreases environmental pollution by omitting the plating process of tooth-like conductive parts.

11 Claims, 8 Drawing Sheets

U.S. PATENT DOCUMENTS

| | | | | | |
|---|---|---|---|---|---|
| 3,019,410 | A * | 1/1962 | Logan et al. | 439/848 |
| 3,855,567 | A * | 12/1974 | Harms et al. | 439/593 |
| 4,138,188 | A * | 2/1979 | Shannon | 439/578 |
| 4,494,812 | A * | 1/1985 | Bolton | 439/434 |
| 4,934,957 | A * | 6/1990 | Bellusci | 439/504 |
| 5,564,951 | A * | 10/1996 | Attal et al. | 439/676 |
| 5,601,452 | A * | 2/1997 | Ruffa | 439/504 |
| 6,010,371 | A * | 1/2000 | Farley et al. | 439/676 |
| 6,386,907 | B1 * | 5/2002 | Ruffa | 439/504 |
| 6,793,537 | B2 * | 9/2004 | Stefaniu et al. | 439/660 |
| 6,871,387 | B2 | 3/2005 | Cheng | |
| 7,322,851 | B2 * | 1/2008 | Brookmire | 439/578 |

FOREIGN PATENT DOCUMENTS

| | | |
|---|---|---|
| CN | 2751455 | 1/2006 |
| CN | 101136512 | 3/2008 |
| CN | 201038356 | 3/2008 |

* cited by examiner

HIGH CONDUCTIVITY ENERGY-SAVING CLAMPING DEVICE

FIELD OF TECHNOLOGY

The invention involves a clamping device to effect conductive connection, and the clamping device is high conductivity energy-saving one using conductive material to directly contact an external conductor.

BACKGROUND OF THE INVENTION

Nowadays, it is common to use the clamp structure in FIG. 1 and FIG. 2 to effect the connection of electric conduction. FIG. 1 and FIG. 2 are drawings of the structure of a known clamp and the enlarged mouth thereof From the drawings, cable 4 goes through clamp 1; conductive material 5 from inside cable 4 is connected to the big tooth 2 set beneath the mouth of clamp 1. The small tooth 3 is set on the clamping region in the mouth of clamp 1. The two teeth meet together to connect the conductor of an external device. When using the clamping device, clamp 1 is opened to effect the connection of the big tooth 2 and the external conductor. Then cable 4 and the two teeth are connected to the external conductor, thereby effecting the circuit connection between different external devices and the cables.

Defects of known clamps in their manufacture and use:

1. Environmental pollution: known clamps use tooth-like conductive parts to connect cables and external conductors. To be economical and artistic, the tooth-like parts are generally made of iron and reprocessed with copper coating and galvanization. Therefore, the environment is seriously polluted during the manufacture.

2. Increased raw material loss: the production of the known clamps, not only requires wire casing and metal wires, but also needs conductive material to produce the tooth-like conductive parts.

3. Poor electric conduction: using tooth-like parts to connect the external conductor, known clamps only have the tooth surface to establish connection, so this small contact area leads to poor electric conduction.

4. Complicated manufacture procedures: to produce known clamps, metal wires need to be connected with the tooth-like conductive parts. Moreover, the tooth-like parts ought to be made independently and then assembled into the whole clamping device. The manufacture procedures are loaded down with trivial details.

DISCLOSURE OF THE INVENTION

The invention is to provide a high conductivity energy-saving clamping device by increasing its contact area with the external conductor to improve the conductivity.

To realize the purpose, the invention provides a clamping device, which comprises a clamp and a cable fixed upon the clamp. The invention has the following characteristics:

Conductive material inside the said cable protrudes and is set on the juncture of the clamp and the external conductor.

When the clamp connects the external conductor, the conductive material meets and contacts the conductor.

Inside the clamping device, the conductive material is plainly set on one part of the juncture of the clamp and the external conductor to form a conductive surface which contacts and meets the external conductor directly.

In the clamping device, conductive materials protruding from the cable is divided into two parts, and are set respectively on two parts of the juncture of the clamp and the external conductor. Two conductive surfaces are thus formed to directly contact and meet the external conductors respectively.

The conductive surface is covered by a metallic member. When the clamping device connects the external conductor, the metallic member directly contacts and grips the conductor. A contact region of the metallic member extends outside the juncture of the clamp. When the clamp connects the external conductor, the metallic member directly contacts the external conductor.

The clamping device includes an insulation plate set inside the juncture of the clamp. Conductive material is plainly laid on the plate.

The conductive material extends vertically from one part of the juncture of the clamp and the external conductor, forming cluster-like conductive material which directly contacts and grips the external conductor.

Conductive material from the cable is divided into two parts, extending vertically from two parts of the juncture of the clamp and the external conductor respectively. Two cluster-like conductive materials are thus formed to directly contact and meet the external conductor respectively.

The energy-saving clamping device includes an insulation plate set inside the juncture.

There are through holes in the insulation plate.

The conductive material goes through the through holes.

Conductive material from the cable is divided into two parts. One is plainly set on one part of the juncture of the clamp and the external conductor to form a conductive surface. The other vertically extends from another part of the juncture to form cluster-like conductive material.

The invention is superior to the known technology with the following advantages:

1. Saving material: the invention does not adopt the extensively used tooth-like conductive parts of known technology, so manufacture process is simplified and raw material & resources saved and cost economized. This is a contribution to the intensive enterprises and economy.

2. High conductivity: the invention employs conductive material to directly connect the external conductor so as to effectively increase the contact area. Therefore, its performance of conductivity is 10% to 15% higher than that of the clamp with the known technology.

3. Environmental protection: the invention does not adopt the tooth-like conductive parts of known technology which are widely used nowadays. So electroplating process is avoided as it is only used for producing the tooth-like parts. This greatly decreases environmental pollution and conforms to the environmental philosophy of emission reduction and low carbon green economy.

4. Various product forms: the invention can be applied to various products with different forms, which will enhance the recognition of the invention indirectly. The invention can be used in all sorts of electric circuit connection via clamps with a wide application range.

DETAILED DESCRIPTION OF THE EMBODIMENTS

The following expatiates upon the preferred application examples of this invention with the figures.

A high conductivity energy-saving clamping device comprises a clamp 1, a cable 4 fixed upon clamp 1 and an insulation plate 6 set inside a juncture at the mouth of clamp 1. Conductive material 5 in the cable 4 extends and is set on the juncture where clamp 1 connects the external conductor. When clamp 1 connects the external conductor, conductive material 5 directly contacts and grips the external conductor.

Embodiment 1

Figure 1:
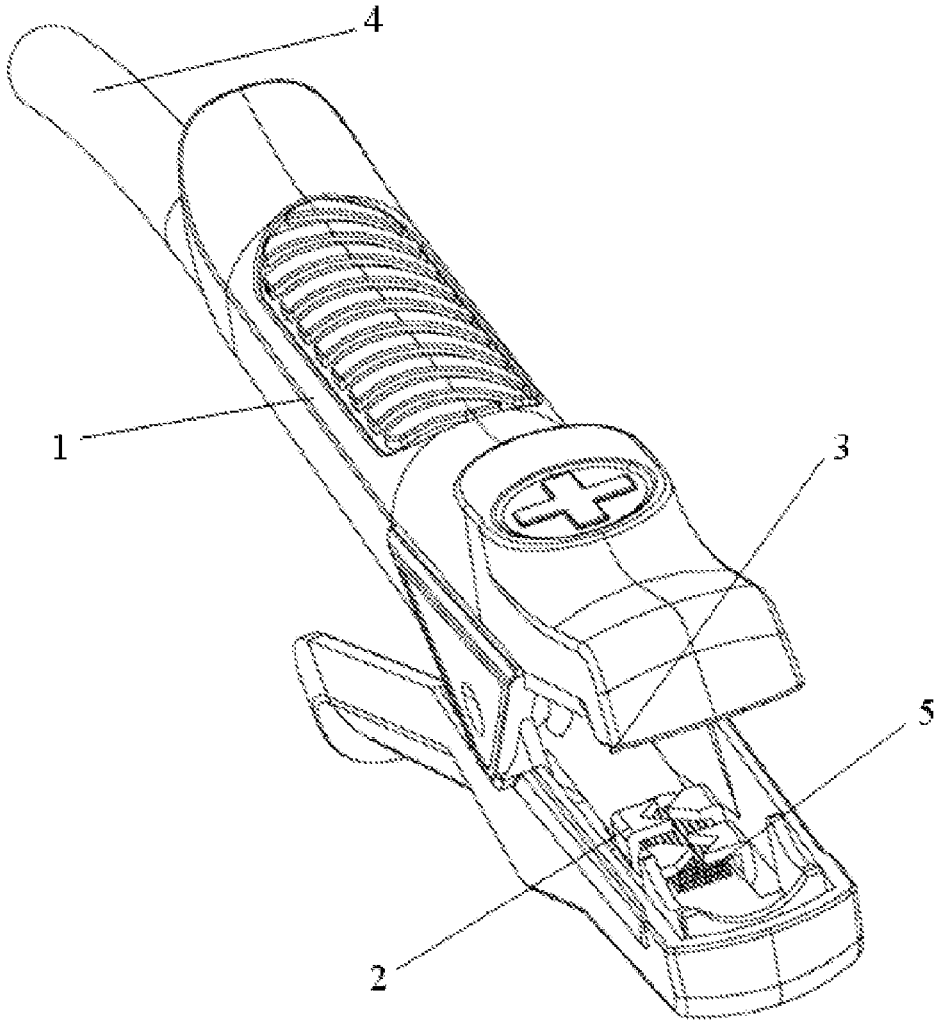
Fig. 1 Prior Art
FIG. 1 shows the structure of the clamp with known technology.
Figure 2:
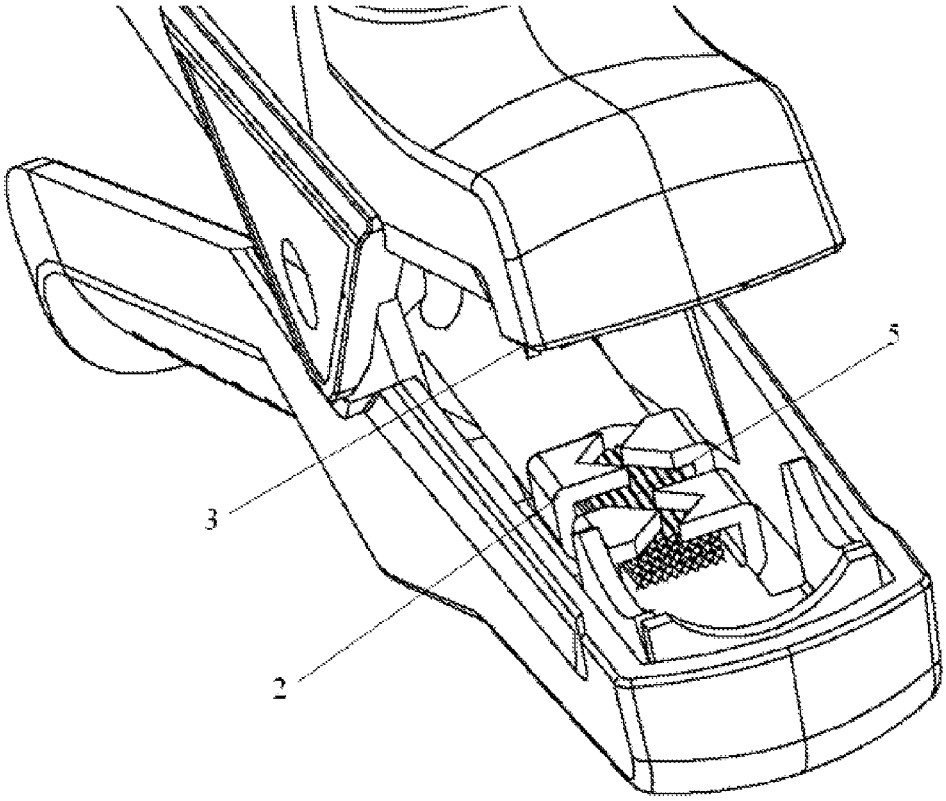
Fig. 2 Prior Art
FIG. 2 is the enlarged drawing of the clamp with known technology.
Figure 3:
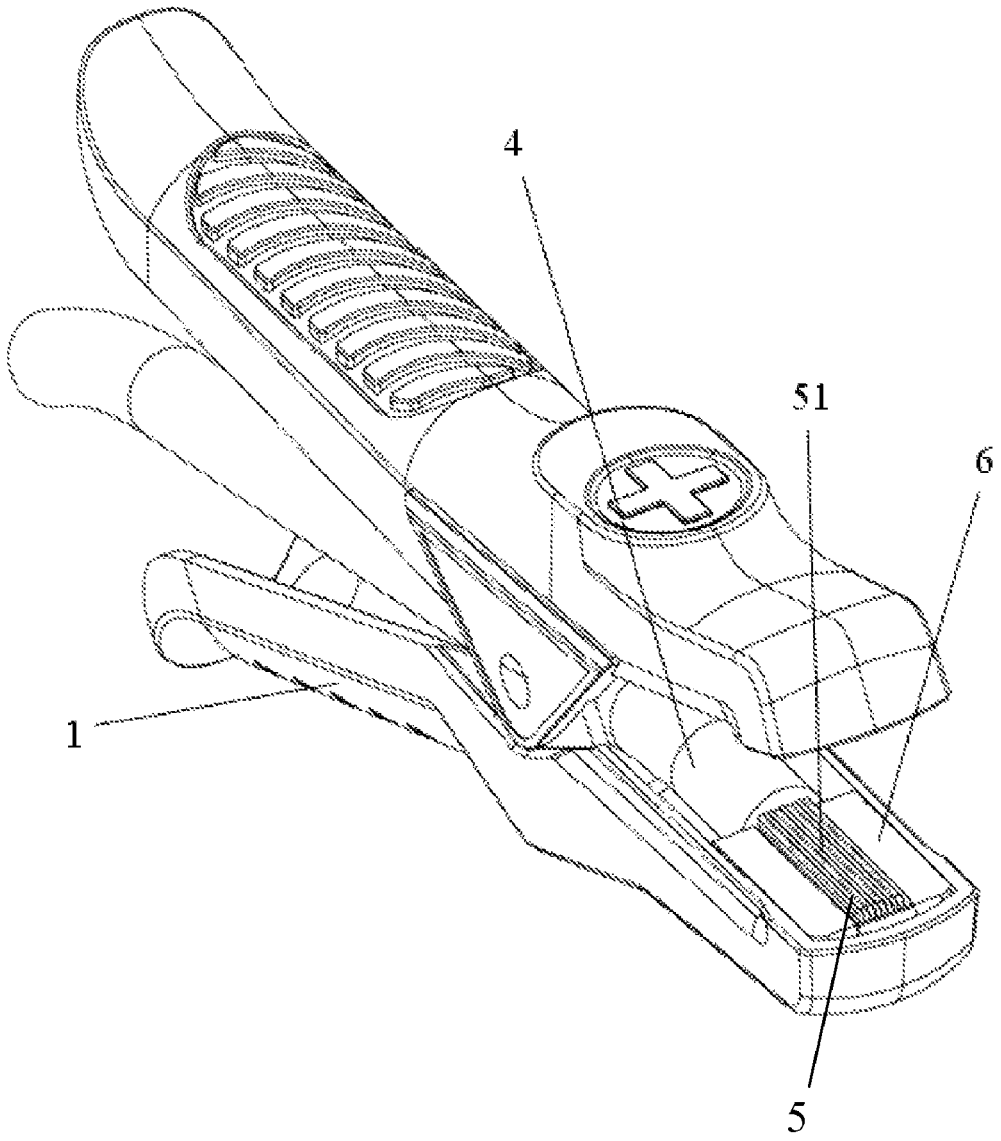
FIG. 3 is the schematic drawing of the high conductivity energy-saving clamping device of this invention.
Figure 4:
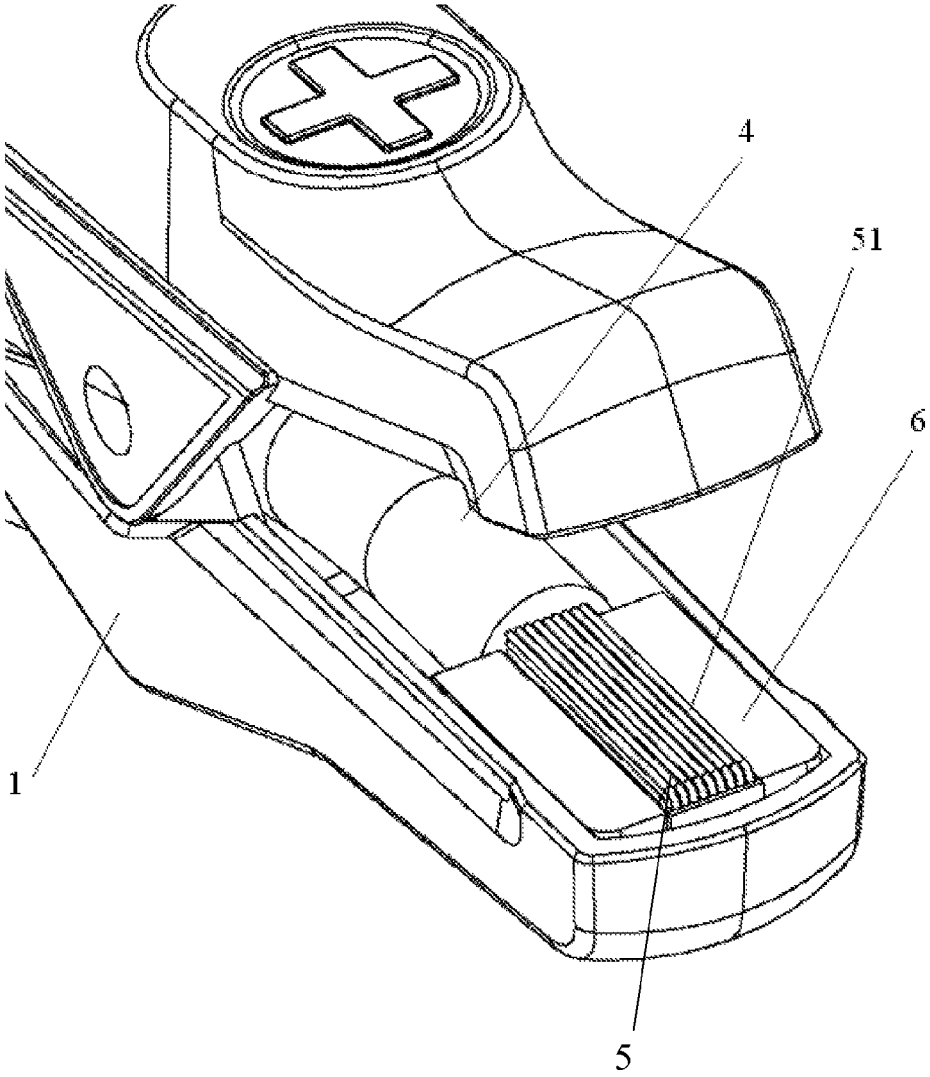
FIG. 4 is the enlarged figure of the conductive material plane in this invention.

As shown in FIG. 3 and FIG. 4, conductive material 5 (usually copper or other metal wires) is plainly set on one part of the juncture at the mouth of clamp 1, and the front end of conductive material 5 is fixed between the mouth of clamp 1 and the insulation plate 6 (in this embodiment, insulation plate 6 is made of plastics). Conductive surface 51 is formed on the surface of the insulation plate 6. When connecting with clamp 1, we open it to expose the conductive surface 51. As clamp 1 connects an external conductor (a wiring terminal for instance), conductive surface 51 directly contacts the wiring terminal to effect electric conduction. Due to the effective increase in contact area, the conductivity performance of the clamping device in this invention is 10% to 15% higher than that of common clamps with known technology.

To better effect the Embodiment 1, we can place metallic members (not shown in the figures) to cover conductive surface 51 such that the members (usually copper pieces) are in direct contact with the external conductor, such as a wiring terminal, to effect the electric conduction. The use of metallic members can reduce the abrasion of conductive material, avoiding disconnection of the conductive material due to excessive force.

The metallic members in this embodiment may comprise a contact region (not shown in the figures) which extends outside the juncture at the mouth of the clamping device. The contact region of the metallic members contacts and grips the external conductor directly.

Figure 5:
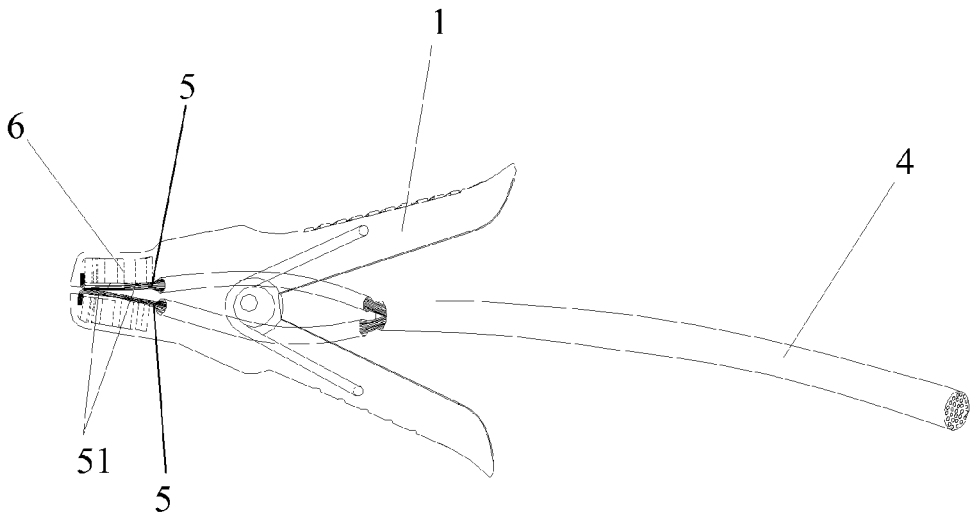
FIG. 5 is about the division of the conductive materials in the invention.

As shown in FIG. 5, when cable 4 is thick, conductive material 5 protrudes from the cable 4 can be divided into two parts, which are plainly set on two parts of the juncture at the mouth of clamp 1 respectively. Two conductive surfaces 51 are thus formed, which directly contact and grip the external conductor. Both of the two parts of the juncture at the mouth of the clamp can conduct electricity. In summary, we may choose to cover metallic members on either or both of the conductive surfaces 51.

Embodiment 2

Figure 6:
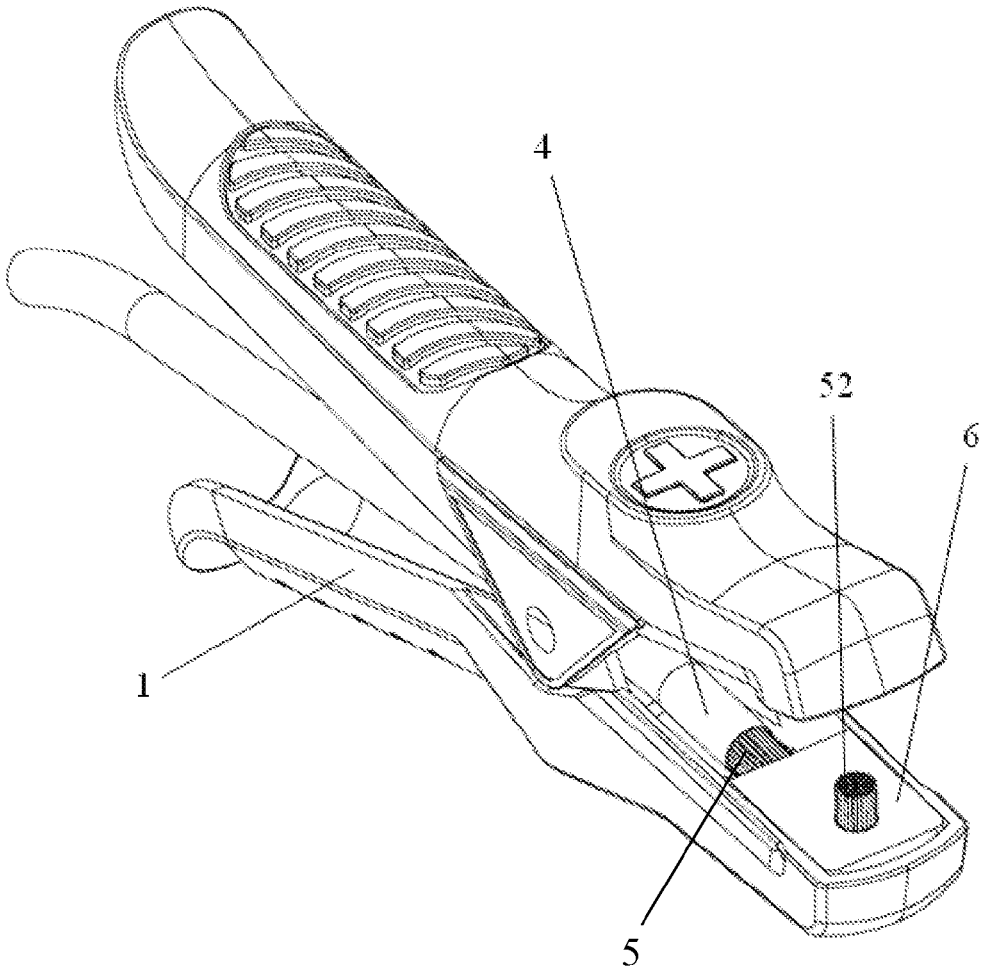
FIG. 6 indicates the second application example of the clamping device in this invention.
Figure 7:
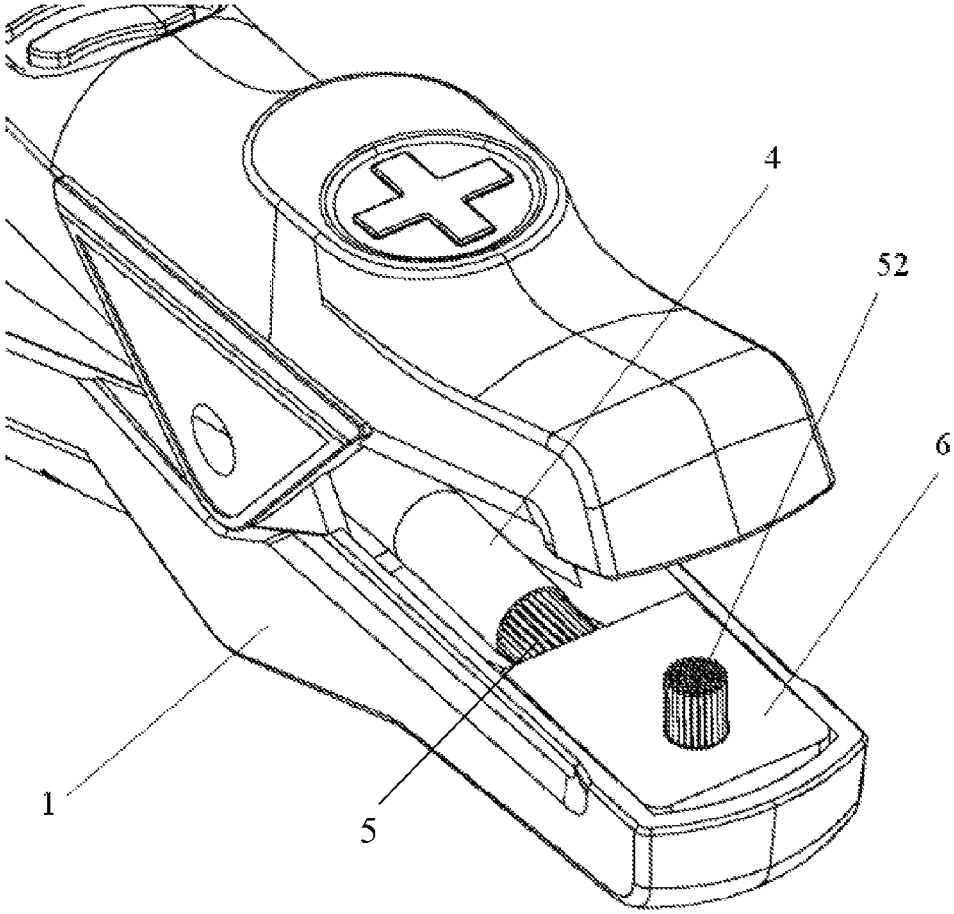
FIG. 7 is the enlarged figure of cluster-like conductive materials of second application example in this invention.

According to different forms of the external conductor, as shown in FIGS. 6 and 7, conductive material 5 goes through a through hole of the insulation plate 6 and extends from the top of the insulation plate 6 to form cluster-like conductive material 52. When using clamp 1 to connect, we open the head of clamp 1 to entirely expose the cluster-like conductive material 52. When clamp 1 connects an external conductor, such as a wiring terminal, cluster-like conductive material 52 contacts the wiring terminal, and electric conduction is achieved. Due to effectively increased contact area, the conductivity performance of the clamping device of this invention is 10% to 15% higher than that of common clamps of known technology.

Figure 8:
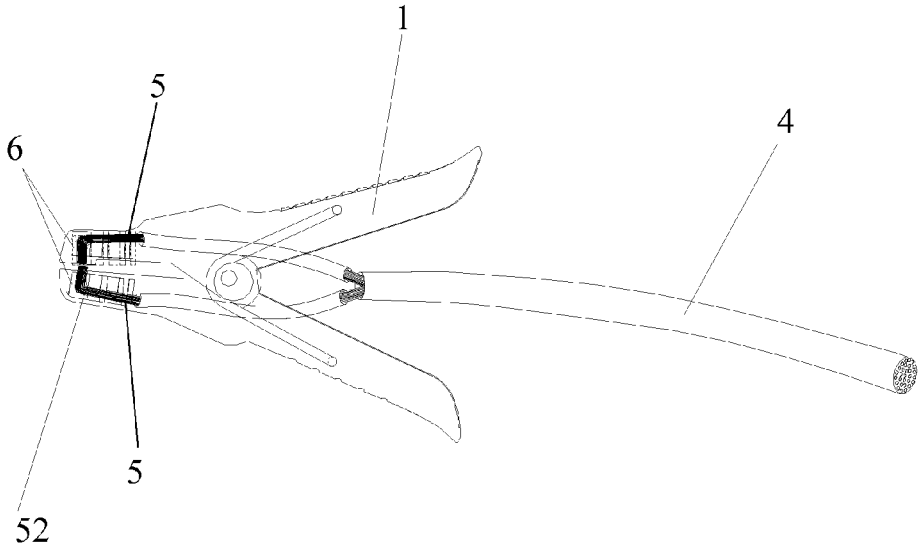
FIG. 8 displays how the conductive material of the cable is divided into two parts in this invention.

As shown in FIG. 8, if conductive material 5 from the cable 4 is divided into two parts, and the two parts vertically extend from the two parts of the juncture at the mouth of clamp 1 respectively, two cluster-like conductive material 52 are thus formed to contact and grip the external conductor directly. Then both parts of the juncture at the mouth of clamp 1 can conduct electricity.

Embodiment 3

Figure 9:
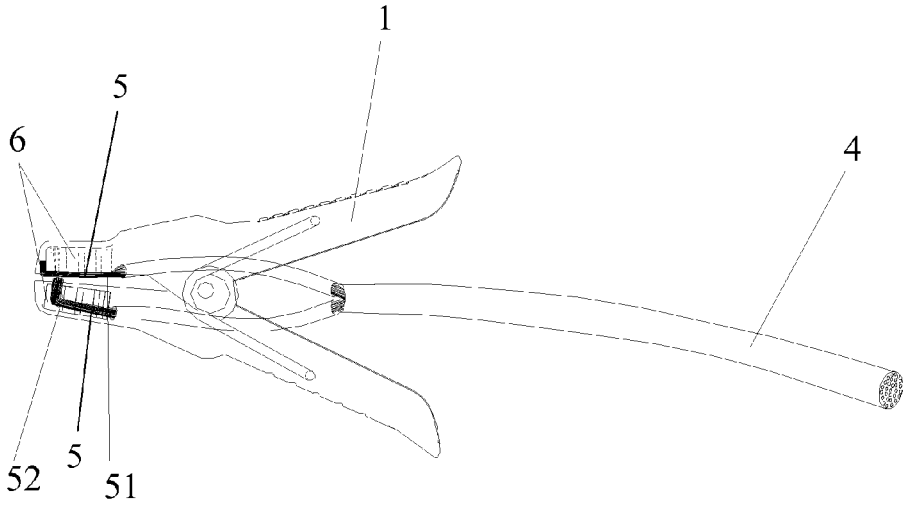
FIG. 9 is the third application example of the clamping device in this invention.

According to the different forms of external conductor required by the clamp, as shown in FIG. 9, conductive material 5 from the cable 4 is divided into two parts. One part plainly set on one part of the juncture at the mouth of clamp 1 forms the conductive surface 51 and another part vertically extending from another part of the juncture at the mouth of clamp 1 forms cluster-like conductive material 52. When connecting with clamp 1, we open it to expose conductive surface 51 and cluster-like conductive material 52. As clamp 1 connects the external conductor (a wiring terminal for instance), conductive surface 51 and cluster-like conductive material 52 directly contact the wiring terminal to conduct electricity. Due to the effective increase in contact area, the conductivity performance of the clamping device in this invention is 10% to 15% higher than that of common clamps with known technology.

From the above mentioned embodiments, the invention has the following advantages:

1. Material saving: this invention does not employ the extensively used tooth-like conductive parts of known technology, so manufacture process is simplified and raw material & resources saved and cost economized. It is a contribution to intensive enterprises and economy.

2. High conductivity: the invention employs conductive materials to directly connect the external conductor so as to effectively increase the contact area. Therefore, its conductivity performance is 10% to 15% higher than that of the clamp with known technology adopting the tooth-like conductive parts to connect the cable with the external conductor.

3. Environmental protection: the invention does not adopt the tooth-like conductive parts of known technology which are widely used nowadays. So electroplating process is avoided as it is only used for producing the tooth-like parts. This greatly decreases environmental pollution and conforms to the environmental philosophy of emission reduction and low carbon green economy.

4. Various product forms: the invention can be applied to various products with different forms, which will enhance the recognition of the invention indirectly. The invention can be used in all sorts of electric circuit connection via clamps with a wide application range.

Although the invention is given detailed introduction from the above optimum selecting implement examples, the above description shall not be taken as limitations to the invention. Obviously a skilled person in this field can make a variety of modifications and substitutions to it after reading the above content. Therefore, the protection range of this invention shall be defined by the attached patent claims.

The invention claimed is:

1. A high conductivity energy-saving clamping device comprises a clamp and a cable fixed upon the clamp, wherein, inside the cable, a conductive material protrudes and is set on a juncture of the clamp and an external conductor, when the clamp is connected to the external conductor, the conductive material and the external conductor contact and meet directly, wherein said conductive material is plainly set upon one part of the juncture of the clamp and the external conductor to form a coplanar conductive surface, which directly contacts and meets the external conductor.

2. The high conductivity energy-saving clamping device of claim 1, wherein the said conductive material from the cable is divided into two parts, which are plainly set upon two parts of the juncture of the clamp and the external conductor respectively, so as to form two conductive surfaces which directly contact and meet the external conductor respectively.

3. The high conductivity energy-saving clamping device of claim 2, wherein the said conductive surface is covered by a metallic member, which directly contacts and meets the external conductor when the clamp connects the external conductor.

4. The high conductivity energy-saving clamping device of claim 1, wherein the said conductive surface is covered by a metallic member, which directly contacts and meets the external conductor when the clamp connects the external conductor.

5. The high conductivity energy-saving clamping device of claim 4, wherein the said metallic member comprises a contact region which extends outside the juncture of the clamp such that when the clamp connects the external conductor, the contact region of the metallic member contacts and meets the external conductor directly.

6. The high conductivity energy-saving clamping device of claim 5, further comprising an insulation plate inside the juncture of the clamp, and the conductive material is plainly laid on the surface of the insulation plate.

7. A high conductivity energy-saving clamping device comprises a clamp and a cable fixed upon the clamp, wherein, inside the cable, a conductive material protrudes and is set on a juncture of the clamp and an external conductor, when the clamp is connected to the external conductor, the conductive material and the external conductor contact and meet directly, wherein the said conductive material extends above and vertically from one part of the juncture of the clamp and the external conductor, so as to form cluster-like conductive material, which contacts and meets the external conductor directly.

8. The high conductivity energy-saving clamping device of claim 7, further comprising an insulation plate inside the juncture of the clamp, wherein the insulation plate comprises a through hole and wherein the conductive material goes through the hole of the insulation plate.

9. The high conductivity energy-saving clamping device of claim 7, wherein the said conductive material from the cable is divided into two parts, one part of the conductive material is plainly set on one part of the juncture of the clamp and the external conductor to form a conductive surface, the other part extends above and vertically from the other part of the juncture of the clamp and the external conductor to form cluster-like conductive material.

10. The high conductivity energy-saving clamping device of claim 7, wherein the said conductive material from the cable is divided into two parts, which extend vertically from the two parts of the juncture of the clamp and the external conductors, respectively, so as to form two cluster-like conductive material to contact and meet the external conductors directly.

11. The high conductivity energy-saving clamping device of claim 10, further comprising an insulation plate inside the juncture of the clamp, wherein the insulation plate comprises a through hole and wherein the conductive material goes through the hole of the insulation plate.

* * * * *